US009383692B2

(12) United States Patent
Ueno et al.

(10) Patent No.: US 9,383,692 B2
(45) Date of Patent: Jul. 5, 2016

(54) FIXING DEVICE AND IMAGE FORMING APPARATUS

(71) Applicants: Satoshi Ueno, Tokyo (JP); Jun Okamoto, Tokyo (JP); Tetsuo Tokuda, Kanagawa (JP); Naoto Suzuki, Kanagawa (JP); Takashi Sakamaki, Kanagawa (JP); Fumihiro Hirose, Kanagawa (JP); Motoyoshi Yamano, Tokyo (JP)

(72) Inventors: Satoshi Ueno, Tokyo (JP); Jun Okamoto, Tokyo (JP); Tetsuo Tokuda, Kanagawa (JP); Naoto Suzuki, Kanagawa (JP); Takashi Sakamaki, Kanagawa (JP); Fumihiro Hirose, Kanagawa (JP); Motoyoshi Yamano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/050,790

(22) Filed: Oct. 10, 2013

(65) Prior Publication Data

US 2014/0112680 A1 Apr. 24, 2014

(30) Foreign Application Priority Data

Oct. 24, 2012 (JP) ..... 2012-234604
Jan. 31, 2013 (JP) ..... 2013-016718

(51) Int. Cl.
*G03G 15/20* (2006.01)
*G03G 21/20* (2006.01)

(52) U.S. Cl.
CPC ..... *G03G 15/2017* (2013.01); *G03G 21/206* (2013.01)

(58) Field of Classification Search
CPC ..... G03G 15/2017; G03G 21/206
USPC ..... 399/92, 93, 67, 70
See application file for complete search history.

(56) References Cited

U.S. PATENT DOCUMENTS

| | | | | |
|---|---|---|---|---|
| 2007/0059017 | A1 | 3/2007 | Omura | |
| 2008/0226326 | A1* | 9/2008 | Seo et al. | 399/69 |
| 2011/0052245 | A1 | 3/2011 | Shinshi et al. | |
| 2011/0280607 | A1* | 11/2011 | Tanaka | 399/67 |
| 2011/0293308 | A1* | 12/2011 | Suzuki et al. | 399/69 |
| 2013/0078016 | A1* | 3/2013 | Koyama et al. | 399/328 |

FOREIGN PATENT DOCUMENTS

| | | | | |
|---|---|---|---|---|
| JP | 62123484 A | * | 6/1987 | G03G 15/20 |
| JP | 04032454 A | * | 2/1992 | |
| JP | 05107983 A | * | 4/1993 | G03G 15/20 |
| JP | 10316263 A | * | 12/1998 | |

(Continued)

OTHER PUBLICATIONS

Machine translation of Murofushi, Seiji 1993.*

(Continued)

*Primary Examiner* — David Gray
*Assistant Examiner* — Sevan A Aydin
(74) *Attorney, Agent, or Firm* — Oblon, McClelland, Maier & Neustadt, L.L.P.

(57) ABSTRACT

A fixing device includes a fixing rotary body to come into contact with a toner image on a recording medium and a pressing rotary body separably pressed against the fixing rotary body to press the recording medium against the fixing rotary body. A cooler, disposed opposite the pressing rotary body to cool the pressing rotary body, includes a fan to move air to the pressing rotary body and at least one inlet duct interposed between the fan and the pressing rotary body to supply air from the fan to the pressing rotary body. The at least one inlet duct selectively cools the pressing rotary body in a variable axial span in an axial direction thereof.

16 Claims, 6 Drawing Sheets

(56) References Cited

FOREIGN PATENT DOCUMENTS

| | | | | | |
|---|---|---|---|---|---|
| JP | 2000231269 | A | * | 8/2000 | ..... G03G 15/14 |
| JP | 2007-079142 | | | 3/2007 | |
| JP | 2007206128 | A | * | 8/2007 | |
| JP | 2010249994 | A | * | 11/2010 | |
| JP | 2011-048167 | | | 3/2011 | |
| JP | 2011-053380 | | | 3/2011 | |
| JP | 2013-120314 | | | 6/2013 | |

OTHER PUBLICATIONS

Machine translation of Ando et al. 2000.*
Machine translation of Miyazaki, Tadashi 2007.*
Machine translation of Terashita, Yuji 2010.*
Translation of p. 5 of Tanaka et al., JP S62-123484.*
Machine translation of Tsunoda, JP H10-316263 (1998).*
Partial Translatin of Tanaka et al., JP S62-123484.*

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2012-234604, filed on Oct. 24, 2012, and 2013-016718, filed on Jan. 31, 2013, in the Japanese Patent Office, the entire disclosure of each of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatuses are requested to form a high quality toner image on a recording medium at high speed while saving energy. In order to address those requests, the image forming apparatuses employ fixing devices of various types, such as a roller type, a belt type, and a film type, configured to improve heating efficiency for heating the recording medium.

For example, the roller type fixing device may include a fixing roller heated by a heater and a pressing roller pressed against the fixing roller. As a recording medium bearing a toner image is conveyed through a fixing nip formed between the fixing roller and the pressing roller, the fixing roller and the pressing roller apply heat and pressure to the recording medium, melting and fixing the toner image on the recording medium.

The belt type fixing device may include a fixing belt looped over at least two rollers and a pressing roller pressed against the fixing belt to form a fixing nip between the pressing roller and the fixing belt. The at least two rollers may be a fixing roller pressing the fixing belt against the pressing roller and having a decreased thermal conductivity and a heating roller accommodating a heater.

The film type fixing device may include a thin, endless fixing film having a decreased heat capacity and a pressing roller contacting the fixing film to form a fixing nip therebetween. At the fixing nip, the pressing roller presses the recording medium against a heater via the fixing film. As the fixing film sliding over the heater conveys the recording medium through the fixing nip, the fixing film heated by the heater heats the recording medium.

Those fixing devices use a halogen heater, a ceramic heater, an induction heater, or the like as a heater that heats the fixing roller, the fixing belt, and the fixing film.

For example, JP-2007-079142-A discloses a fixing device incorporating an induction heater. A pressing roller is pressed against a fixing roller via a fixing sleeve to form a fixing nip between the pressing roller and the fixing sleeve. The fixing sleeve constructed of a release layer, an elastic layer, and a heat generation layer accommodates a fixing roller constructed of an elastic layer and a core metal. As a coil of the induction heater generates a magnetic flux that induces an eddy current in the heat generation layer of the fixing sleeve, the eddy current generates Joule heat that heats the recording medium conveyed over the fixing sleeve.

In order to address the request to form a high quality toner image, the temperature of the pressing roller may be controlled. For example, JP-2011-048167-A discloses a cooler situated outside the fixing device and configured to cool the fixing device.

Further, in order to address the request to form a high quality toner image at high speed while saving energy, the fixing roller, the pressing roller, and the heating roller may have a decreased heat capacity. However, the rollers having the decreased heat capacity may decrease the thermal conductivity in an axial direction of the rollers. Accordingly, as recording media of various sizes are conveyed over the rollers, the temperature of the rollers may vary in the axial direction thereof. For example, after a plurality of small recording media is conveyed over the rollers continuously, both lateral ends of the rollers in the axial direction thereof where the small recording media are not conveyed and therefore do not draw heat from the rollers may overheat. Consequently, uneven temperature of the rollers in the axial direction thereof may degrade the quality of the toner image fixed on the recording medium.

SUMMARY

This specification describes below an improved fixing device. In one exemplary embodiment, the fixing device includes a fixing rotary body to come into contact with a toner image on a recording medium and a pressing rotary body separably pressed against the fixing rotary body to press the recording medium against the fixing rotary body. A cooler, disposed opposite the pressing rotary body to cool the pressing rotary body, includes a fan to move air to the pressing rotary body and at least one inlet duct interposed between the fan and the pressing rotary body to supply air from the fan to the pressing rotary body. The at least one inlet duct selectively cools the pressing rotary body in a variable axial span in an axial direction thereof.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
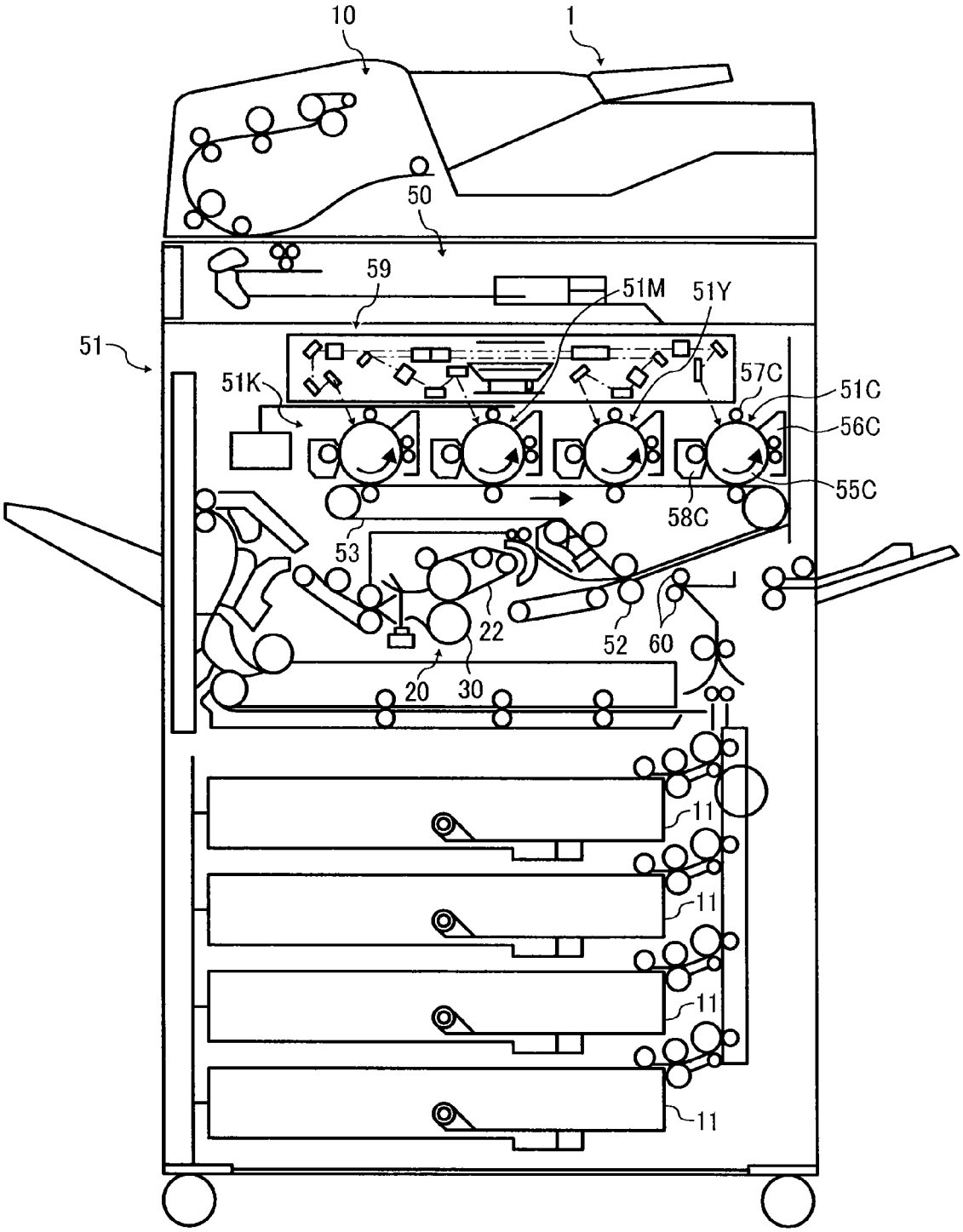
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a digital copier that forms color and monochrome toner images on recording media by electrophotography.

As shown in FIG. 1, the image forming apparatus 1 includes an auto document feeder (ADF) 10 disposed atop the image forming apparatus 1; a scanner 50 situated below the ADF 10; an image forming portion 51 situated below the scanner 50; and a plurality of paper trays 11 situated below the image forming portion 51. The ADF 10 loads and conveys a plurality of originals to the scanner 50 continuously. The scanner 50 optically reads an image on an original conveyed from the ADF 10 into image data. The paper trays 11 load a plurality of recording media (e.g., sheets) to be conveyed to the image forming portion 51. For example, the recording media include plain paper, thick paper, thin paper, coated paper, postcards, overhead projector (OHP) transparencies, and the like. The image forming portion 51 forms a toner image on a recording medium conveyed from one of the paper trays 11. Since the image forming apparatus 1 has a general basic structure, a brief description of a construction and an operation of the image forming apparatus 1 is provided below.

The image forming portion 51 includes four image forming devices 51K, 51M, 51Y, and 51C that form black, magenta, yellow, and cyan toner images, respectively. A writer 59 incorporated in the image forming portion 51 emits light onto the image forming devices 51K, 51M, 51Y, and 51C according to the image data created by the scanner 50 or image data sent from an external device such as a client computer to form electrostatic latent images and resultant black, magenta, yellow, and cyan toner images. Since the image forming devices 51K, 51M, 51Y, and 51C have an identical construction except for the color of toner used therein, a detailed description is given below of a construction of the image forming device 51C that forms a cyan toner image by assigning reference numerals to components incorporated in the image forming device 51C.

As a photoconductive drum 55C rotates counterclockwise in FIG. 1, a charger 57C charges the photoconductive drum 55C. The writer 59 emits light onto the photoconductive drum 55C according to cyan image data, forming an electrostatic latent image thereon. A development device 56C visualizes the electrostatic latent image formed on the photoconductive drum 55C with cyan toner as a cyan toner image. The cyan toner image is primarily transferred onto an intermediate transfer belt 53 rotating clockwise in FIG. 1. Similarly, black, magenta, and yellow toner images are formed by the image forming devices 51K, 51M, and 51Y and primarily transferred onto the intermediate transfer belt 53 such that the black, magenta, yellow, and cyan toner images are superimposed on a same position on the intermediate transfer belt 53, forming a color toner image thereon. After the primary transfer, a cleaner 58C removes residual cyan toner failed to be transferred onto the intermediate transfer belt 53 and therefore remaining on the photoconductive drum 55C therefrom.

A recording medium is conveyed from one of the plurality of paper trays 11 to a registration roller pair 60. After the registration roller pair 60 corrects skew of the recording medium, the registration roller pair 60 conveys the recording medium to a secondary transfer roller 52 at a time when the color toner image formed on the intermediate transfer belt 53 reaches the secondary transfer roller 52. As the recording medium is conveyed between the intermediate transfer belt 53 and the secondary transfer roller 52, the secondary transfer roller 52 secondarily transfers the color toner image formed on the intermediate transfer belt 53 onto the recording medium. After the secondary transfer, the recording medium bearing the color toner image is conveyed to a fixing device 20 through a conveyance path. As the recording medium is conveyed between a fixing belt 22 and a pressing roller 30 of the fixing device 20, the fixing belt 22 and the pressing roller 30 apply heat and pressure to the recording medium, fixing the toner image on the recording medium. After discharged from the fixing device 20, the recording medium bearing the fixed color toner image is discharged from the image forming apparatus 1. Thus, a series of image forming processes is completed.

Figure 2:
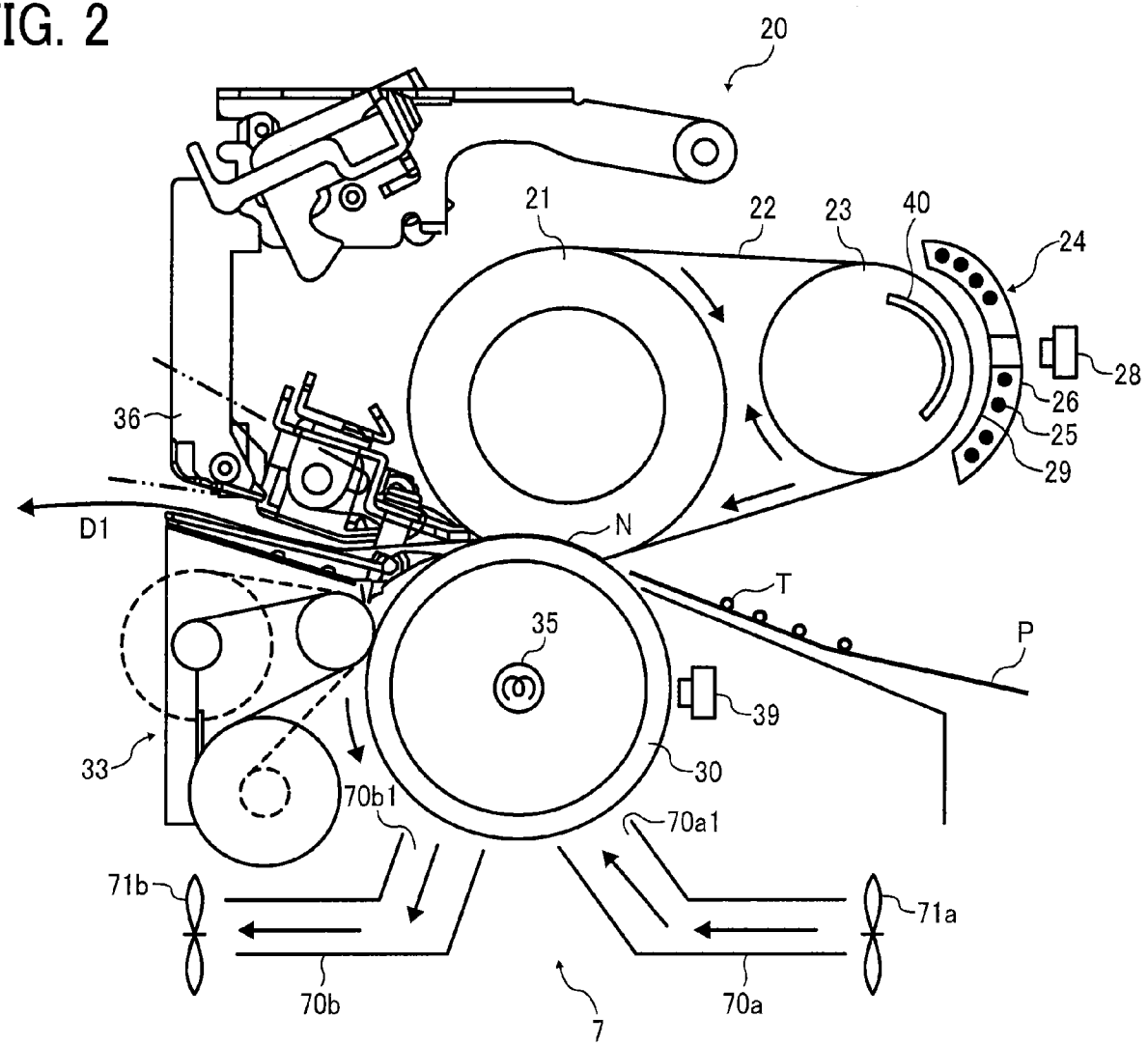
FIG. 2 is a schematic vertical sectional view of a fixing device incorporated in the image forming apparatus shown in FIG. 1.

With reference to FIG. 2, a description is provided of a construction of the fixing device 20 incorporated in the image forming apparatus 1 described above.

FIG. 2 is a schematic vertical sectional view of the fixing device 20. As shown in FIG. 2, the fixing device 20 (e.g., a fuser) includes the fixing belt 22 serving as a fixing rotary body, the pressing roller 30 serving as a pressing rotary body, a fixing roller 21, a heating roller 23, an induction heater 24, and a separation unit 36.

A detailed description is now given of a configuration of the fixing roller 21.

The fixing roller 21 includes an elastic layer constituting a surface layer and made of silicone rubber. The pressing roller 30 is pressed against an outer circumferential surface of the fixing roller 21 via the fixing belt 22 to form a fixing nip N between the pressing roller 30 and the fixing belt 22. A driver drives and rotates the pressing roller 30 counterclockwise and the fixing roller 21 clockwise in FIG. 2, thus rotating the fixing belt 22 pressed against the fixing roller 21 by the pressing roller 30 clockwise in FIG. 2.

A detailed description is now given of a configuration of the fixing belt 22.

The fixing belt 22 is a multilayer endless belt constructed of a base layer made of polyimide resin or the like; an elastic layer made of silicone rubber or the like; and a surface release layer made of fluorochemical or the like. The fixing belt 22 is looped over the heating roller 23 and the fixing roller 21. The release layer of the fixing belt 22 facilitates separation of a toner image T on a recording medium P from the fixing belt 22.

A detailed description is now given of a configuration of the heating roller 23.

The heating roller 23 is made of a magnetic shunt alloy serving as a heat generator and rotatable clockwise in FIG. 2. The magnetic shunt alloy is an alloy of iron and nickel. As the magnetic shunt alloy is heated to a Curie temperature, it loses magnetism and suppresses heat generation, preventing its temperature from increasing further. A magnetic flux shield plate 40 made of a material having a decreased magnetic permeability such as aluminum and copper is situated inside the heating roller 23 and disposed opposite the induction heater 24 via the heating roller 23. A circumferential span of the magnetic flux shield plate 40 substantially corresponds to that of the induction heater 24. Alternatively, the heating roller 23 may be made of a material other than the magnetic shunt alloy. For example, the heating roller 23 may be made of a non-magnetic material such as SUS 304 stainless steel and a ferromagnetic material, such as ferrite, serving as an internal core.

A detailed description is now given of a configuration of the induction heater 24.

The induction heater 24 serves as an external induction heater constructed of a coil 25, a core 26, and a coil guide 29. The induction heater 24 is disposed opposite the heating roller 23 via the fixing belt 22. The coil 25 includes litz wire constructed of bundled thin wire extending in an axial direction of the heating roller 23 and spanning over a part of the fixing belt 22 looped over the heating roller 23 in a circumferential direction of the heating roller 23. The coil guide 29 made of heat resistant resin holds the coil 25. The core 26 made of a magnetically permeable material such as ferrite is disposed opposite the coil 25 extending in the axial direction of the heating roller 23. It is to be noted that a core portion of an induction heater defines a pair of cores disposed opposite each other to facilitate electromagnetic induction heating. That is, the core 26 of the induction heater 24, together with the magnetic shunt alloy or the internal core of the heating roller 23, constitute the core portion of the induction heater 24. According to this exemplary embodiment, the external induction heater 24 serves as a heater. Alternatively, an internal induction heater, a halogen heater, or a ceramic heater may be used as a heater.

A detailed description is now given of a configuration of the pressing roller 30.

The pressing roller 30 is constructed of a metal core and an elastic layer coating the metal core and made of fluoro rubber, silicone rubber, or the like. The pressing roller 30 is pressed against the fixing roller 21 via the fixing belt 22. The pressing roller 30 is separably pressed against the fixing roller 21. A cleaner 33 contacts an outer circumferential surface of the pressing roller 30. A halogen heater 35 is situated inside the pressing roller 30. A thermistor 39 disposed opposite the outer circumferential surface of the pressing roller 30 detects the temperature of the pressing roller 30. A controller (e.g., a processor), that is, a central processing unit (CPU) provided with a random-access memory (RAM) and a read-only memory (ROM), for example, operatively connected to the halogen heater 35 and the thermistor 39 controls the halogen heater 35 based on the temperature of the pressing roller 30 detected by the thermistor 39. A plurality of thermistors 39 may be aligned in an axial direction of the pressing roller 30 to detect temperature distribution on the outer circumferential surface of the pressing roller 30 in the axial direction thereof. A pressurization assembly presses the pressing roller 30 against the fixing roller 21 via the fixing belt 22 and isolates the pressing roller 30 from the fixing belt 22. For example, the pressurization assembly includes an eccentric cam and a lever. As the eccentric cam contacting the lever rotates, the lever contacting the pressing roller 30 presses the pressing roller 30 against the fixing roller 21 via the fixing belt 22 or isolates the pressing roller 30 from the fixing belt 22.

A detailed description is now given of a configuration of other components incorporated in the fixing device 20.

Upstream from an entry to the fixing nip N in a recording medium conveyance direction D1 is a guide plate that guides the recording medium P bearing the toner image T to the fixing nip N. Conversely, downstream from an exit of the fixing nip N in the recording medium conveyance direction D1 is the separation unit 36 including a separation plate that guides the recording medium P discharged from the fixing nip N and separates the recording medium P from the fixing belt 22.

A non-contact temperature detector 28 is situated in proximity to the induction heater 24 and disposed opposite an outer circumferential surface of the fixing belt 22 via the induction heater 24 to detect the temperature of the outer circumferential surface of the fixing belt 22 looped over the heating roller 23. Thus, the controller controls the induction heater 24 based on the temperature of the fixing belt 22 detected by the temperature detector 28.

Below the pressing roller 30 is a cooler 7 constructed of an inlet duct 70*a* and an outlet duct 70*b* coupled with the inlet duct 70*a*. The inlet duct 70*a* includes an opening 70*a*1 disposed opposite the pressing roller 30 and is attached with a fan 71*a*. Similarly, the outlet duct 70*b* includes an opening 70*b*1 disposed opposite the pressing roller 30 and is attached with a fan 71*b*. For example, as described in detail below, the inlet duct 70*a* may be divided into a plurality of ducts aligned in the axial direction of the pressing roller 30 or may be movable in the axial direction of the pressing roller 30. Similarly, the outlet duct 70*b* may be divided into a plurality of ducts aligned in the axial direction of the pressing roller 30 or may be movable in the axial direction of the pressing roller 30. Thus, the inlet duct 70*a* and the outlet duct 70*b* may selectively cool the pressing roller 30 in a variable axial span in the axial direction of the pressing roller 30 perpendicular to the recording medium conveyance direction D1.

A description is provided of an operation of the fixing device 20 having the construction described above.

As the pressing roller 30 rotates counterclockwise in FIG. 2, the pressing roller 30 rotates the fixing belt 22 clockwise in FIG. 2 that in turn rotates the heating roller 23 and the fixing roller 21 clockwise in FIG. 2. As the coil 25 is supplied with a high frequency alternating current, an eddy current generates on a surface of the heating roller 23, causing the heating roller 23 to generate Joule heat by the electric resistance thereof. As the fixing belt 22 looped over the heating roller 23 moves between the induction heater 24 and the heating roller 23, the heating roller 23 heats the fixing belt 22 by the Joule heat. Thereafter, the fixing belt 22 reaches the fixing nip N. On the other hand, a recording medium P bearing a toner image T formed by the image forming processes described above enters the fixing nip N while guided by the guide plate toward the fixing nip N. As the recording medium P is conveyed through the fixing nip N, the recording medium P receives heat from the fixing belt 22 and pressure from the pressing roller 30. Thus, the toner image T is melted and fixed on the recording medium P. Thereafter, the recording medium P is discharged from the fixing nip N.

A detailed description is now given of a configuration of the cooler 7.

Figure 3:
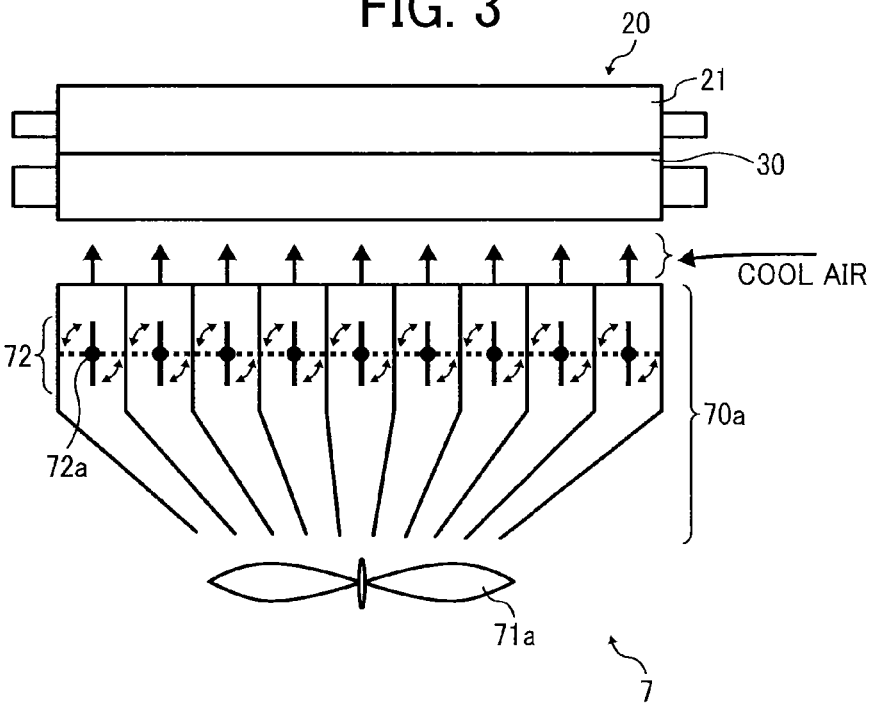
FIG. 3 is a partial side view of the fixing device shown in FIG. 2.

FIG. 3 is a partial side view of the fixing device 20. As shown in FIG. 3, the cooler 7 includes the plurality of inlet ducts 70*a* aligned in the axial direction of the pressing roller 30 to selectively cool the pressing roller 30 in the variable axial span in the axial direction thereof. Each inlet duct 70*a* accommodates a movable shutter 72 configured to open and close the inlet duct 70*a* to supply air into an air path created in the inlet duct 70*a* and shut off air supply. For example, the shutter 72 is a revolving door driven independently. As the shutter 72 revolves about a shutter shaft 72*a*, the shutter 72 opens and closes the air path of the inlet duct 70*a*. Since each shutter 72 is driven independently, the plurality of inlet ducts 70*a* is selectively used. Accordingly, even if the common, single fan 71*a* is driven, air is supplied by the fan 71*a* to the pressing roller 30 through the selectively opened, inlet ducts 70*a* and then taken in and discharged by the fan 71*b* depicted in FIG. 2, thus cooling the pressing roller 30 in a desired axial span in the axial direction thereof. After air from the selectively opened, inlet ducts 70*a* cool the outer circumferential surface of the pressing roller 30, the plurality of outlet ducts 70*b* and the single fan 71*b* draw air supplied from the plurality of inlet ducts 70*a*, preventing air dissipation and thus cooling the pressing roller 30 in the desired axial span thereof precisely.

A description is provided of a cooling operation for cooling the pressing roller 30 performed by the inlet ducts 70*a* and the shutters 72 shown in FIG. 3.

The cooling operation varies depending on an operation state of the fixing device 20, that is, warm-up and conveyance of the recording medium P. During warm-up, the fixing roller 21 is requested to be heated sufficiently to a predetermined temperature. Conversely, the pressing roller 30 is not requested to be heated to the identical predetermined temperature during warm-up. Further, a warm-up time is requested to be shortened.

To address those requests, during warm-up, the halogen heater 35 heats the pressing roller 30 while the pressing roller 30 is isolated from the fixing belt 22 and idly rotated counterclockwise in FIG. 2. Since heat is dissipated from both lateral ends of the pressing roller 30 in the axial direction thereof, the temperature of the pressing roller 30 may vary in the axial direction thereof. For example, the temperature of a center of the pressing roller 30 in the axial direction thereof is high while the temperature of both lateral ends of the pressing roller 30 in the axial direction thereof is low. To address this circumstance, the inlet ducts 70*a* disposed opposite the center of the pressing roller 30 in the axial direction thereof are selectively opened to cool the center of the pressing roller 30 in the axial direction thereof, thus eliminating temperature variation of the pressing roller 30.

Conversely, during conveyance of the recording medium P, the fans 71*a* and 71*b* are driven based on the temperature of the pressing roller 30 detected by the thermistor 39. For example, when the detected temperature of the pressing roller 30 is relatively high, the fans 71*a* and 71*b* are driven to cool the pressing roller 30. Contrarily, when the detected temperature of the pressing roller 30 is relatively low, the fans 71*a* and 71*b* are halted. In order to selectively open the inlet ducts 70*a* as described above, lateral end shutters disposed opposite both lateral ends of the pressing roller 30 in the axial direction thereof are opened and closed by an interlock between the lateral end shutters and the pressurization assembly that presses the pressing roller 30 against the fixing belt 22 and isolates the pressing roller 30 from the fixing belt 22.

Figure 4:
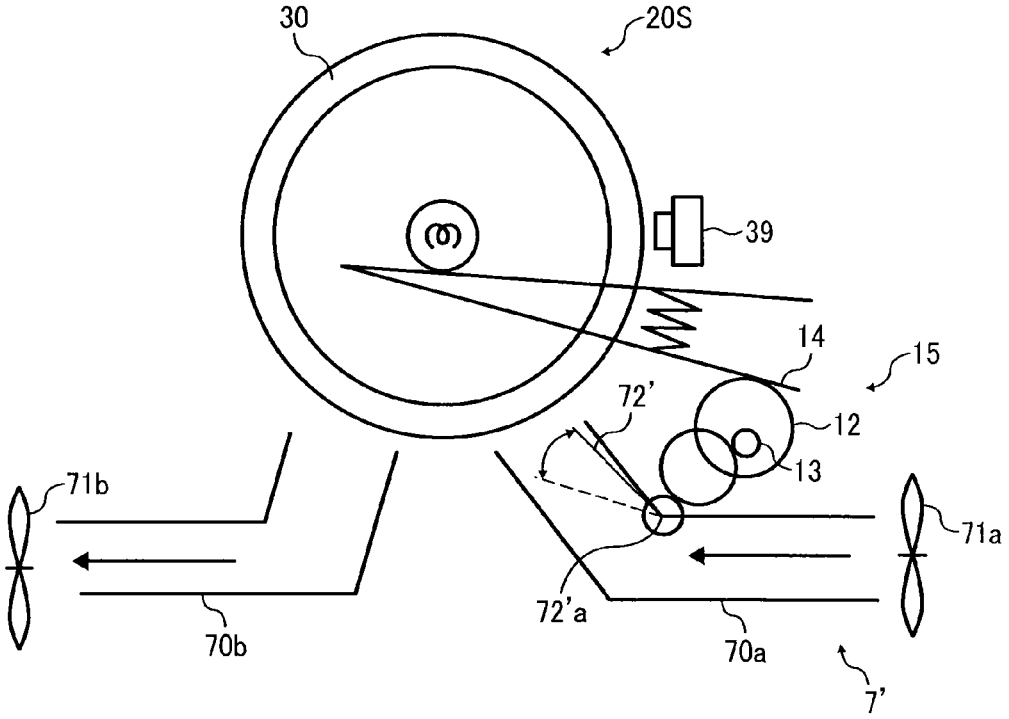
FIG. 4 is a partial vertical sectional view of a fixing device incorporating a link shutter.
Figure 5:
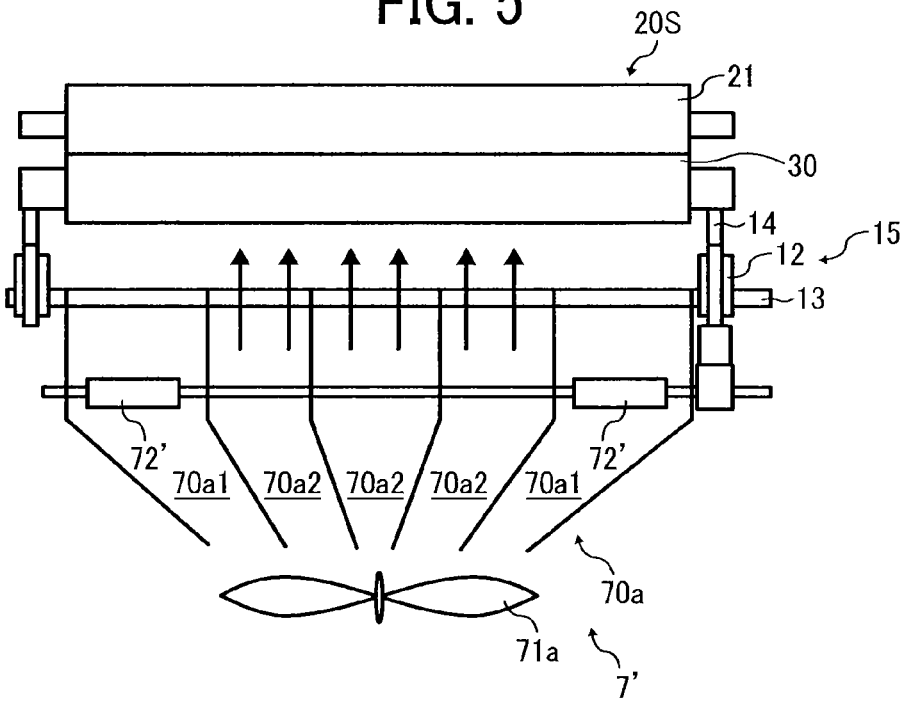
FIG. 5 is a side view of the fixing device shown in FIG. 4.

FIGS. 4 and 5 illustrate the interlock between the lateral end shutters and a pressurization assembly 15. FIG. 4 is a partial vertical sectional view of a fixing device 20S incorporating the interlock. FIG. 5 is a side view of the fixing device 20S.

As shown in FIGS. 4 and 5, the pressurization assembly 15 includes a lever 14 contacting a shaft of the pressing roller 30; a cam 12 contacting the lever 14; and a cam shaft 13 about which the cam 12 is pivotable. As shown in FIG. 5, the fixing device 20S includes a cooler 7' incorporating a link shutter 72' disposed opposite each lateral end of the pressing roller 30 in the axial direction thereof. The link shutter 72' is connected to the cam shaft 13. As the cam 12 pivots about the cam shaft 13, the link shutter 72' pivots as shown in FIG. 4 to close the air path of the inlet duct 70*a*. Since the link shutters 72' are disposed opposite both lateral ends of the pressing roller 30 in the axial direction thereof, lateral end inlet ducts 70*a*1 disposed opposite both lateral ends of the pressing roller 30 in the axial direction thereof are closed by the link shutters 72', respectively, thus interrupting cooling of the pressing roller 30. As the pressurization assembly 15 isolates the pressing roller 30 from the fixing belt 22, the pressurization assembly 15 causes the link shutters 72' to close the lateral end inlet ducts 70*a*1 disposed opposite both lateral ends of the pressing roller 30 in the axial direction thereof while center inlet ducts 70*a*2 disposed opposite the center of the pressing roller 30 in the axial direction thereof are opened as shown in FIG. 5. Conversely, as the pressurization assembly 15 presses the pressing roller 30 against the fixing belt 22, all the inlet ducts 70*a*, that is, both the lateral end inlet ducts 70*a*1 and the center inlet ducts 70*a*2, are opened.

As shown in FIG. 5, the center inlet ducts 70*a*2 disposed opposite the center of the pressing roller 30 in the axial direction thereof are not attached with the link shutters 72'. Alternatively, the lateral end inlet ducts 70*a*1 disposed opposite both lateral ends of the pressing roller 30 in the axial direction thereof may be attached with link shutters not interlocked with the pressurization assembly 15 and actuated independently.

As shown in FIG. 4, the link shutter 72' is pivotable about a link shutter shaft 72'*a* extending in the axial direction of the pressing roller 30. Conversely, as shown in FIG. 3, the shutter 72 is pivotable about the shutter shaft 72*a* extending in a direction perpendicular to the axial direction of the pressing roller 30.

The shape of the cam 12 and the link shutter 72' may be modified to correspond to various axial spans of each lateral end of the pressing roller 30 where recording media P are not conveyed, which vary depending on various sizes of recording media P, thus eliminating temperature variation of the pressing roller 30 in the axial direction thereof.

With reference to FIGS. 3 and 4, a description is provided of opening and closing of the inlet ducts 70*a*.

During warm-up, the fans 71*a* and 71*b* are actuated and unactuated based on the temperature of the pressing roller 30 detected by the thermistor 39. For example, as shown in FIG. 5, the center inlet ducts 70*a*2 disposed opposite the center of the pressing roller 30 in the axial direction thereof are opened and the lateral end inlet ducts 70*a*1 disposed opposite both lateral ends of the pressing roller 30 in the axial direction thereof are closed based on the temperature of the center and both lateral ends of the pressing roller 30. Alternatively, all the center inlet ducts 70*a*2 and the lateral end inlet ducts 70*a*1 may be opened. Similarly, as shown in FIG. 3, the inlet ducts 70*a* disposed opposite the center of the pressing roller 30 in the axial direction thereof are opened and the inlet ducts 70*a* disposed opposite both lateral ends of the pressing roller 30 in the axial direction thereof are closed based on the temperature of the center and both lateral ends of the pressing roller 30. Alternatively, all the inlet ducts 70*a* may be opened.

Conversely, during conveyance of the recording medium P, the fans 71*a* and 71*b* are actuated and unactuated based on the temperature of the pressing roller 30 detected by the thermistor 39. For example, as shown in FIG. 3, the inlet ducts 70*a* disposed opposite the center of the pressing roller 30 in the axial direction thereof are closed and the inlet ducts 70*a* disposed opposite both lateral ends of the pressing roller 30 in the axial direction thereof are opened based on the temperature of the center and both lateral ends of the pressing roller 30. Alternatively, all the inlet ducts 70*a* may be opened. Accordingly, the cam 12 moves the link shutter 72' as below.

As one example with the construction shown in FIG. 5, as the pressurization assembly 15 isolates the pressing roller 30 from the fixing belt 22, the cam 12 pivots about the cam shaft 13 to open and close the link shutter 72' disposed opposite each lateral end of the pressing roller 30 in the axial direction thereof to three states: a first state in which all the inlet ducts 70*a*, that is, both the lateral end inlet ducts 70*a*1 and the center inlet ducts 70*a*2, are opened when the pressurization assembly 15 isolates the pressing roller 30 from the fixing belt 22; a second state in which the center inlet ducts 70*a*2 disposed opposite the center of the pressing roller 30 in the axial direction thereof are opened and the lateral end inlet ducts 70*a*1 disposed opposite both lateral ends of the pressing roller 30 in the axial direction thereof are closed when the pressurization assembly 15 isolates the pressing roller 30 from the fixing belt 22; and a third state in which all the inlet ducts 70*a* are opened when the pressurization assembly 15 presses the pressing roller 30 against the fixing belt 22.

As another example with the construction shown in FIG. 4, as the pressurization assembly 15 presses the pressing roller 30 against the fixing belt 22, the cam 12 pivots about the cam shaft 13 to open the link shutter 72' disposed opposite each lateral end of the pressing roller 30 in the axial direction thereof so that all the inlet ducts 70*a* are opened when the pressurization assembly 15 presses the pressing roller 30 against the fixing belt 22.

As yet another example with the construction shown in FIG. 3, the inlet ducts 70*a* disposed opposite the center of the pressing roller 30 in the axial direction thereof are closed and the inlet ducts 70*a* disposed opposite both lateral ends of the pressing roller 30 in the axial direction thereof are opened when the pressurization assembly 15 presses the pressing roller 30 against the fixing belt 22. However, such configuration of the cam 12 may be modified.

Figure 6:
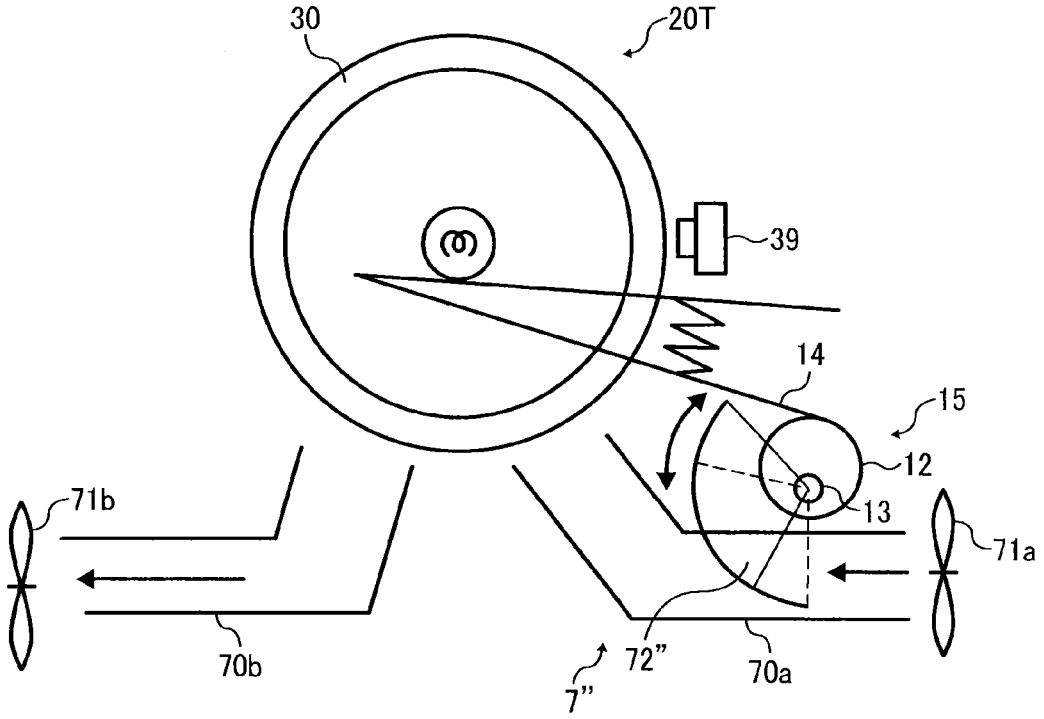
FIG. 6 is a partial vertical sectional view of a fixing device incorporating a link shutter as a first variation of the link shutter shown in FIG. 4.
Figure 7:
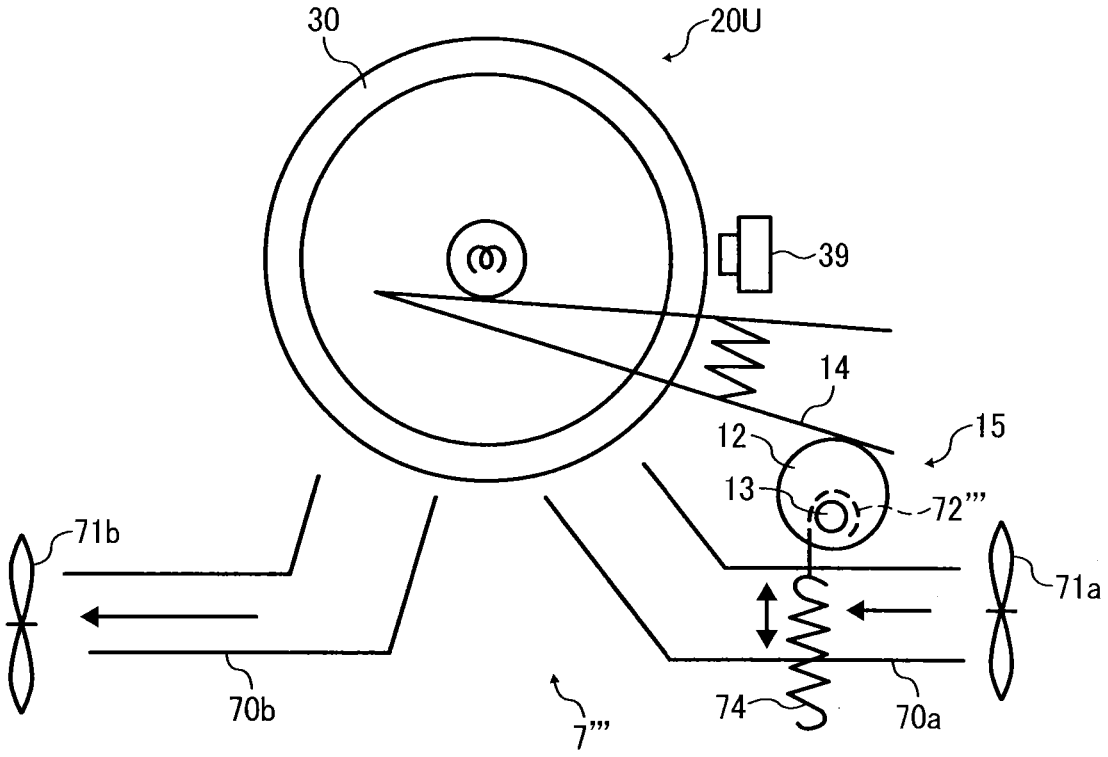
FIG. 7 is a partial vertical sectional view of a fixing device incorporating a link shatter as a second variation of the link shutter shown in FIG. 4.

With reference to FIGS. 6 and 7, a description is provided of two variations of the link shutter 72'.

FIG. 6 is a partial vertical sectional view of a fixing device 20T incorporating a link shutter 72" as a first variation. As shown in FIG. 6, the fixing device 20T includes a cooler 7" incorporating the link shutter 72" pivotally mounted on the cam shaft 13 directly. As the cam 12 pivots about the cam shaft 13, the cam 12 causes the link shutter 72" to selectively open and close the inlet duct 70*a*.

FIG. 7 is a partial vertical sectional view of a fixing device 20U incorporating a link shatter 72'" as a second variation. As shown in FIG. 7, the fixing device 20U includes a cooler 7'" incorporating the link shutter 72'". The link shutter 72'" is a shade having one end anchored to the cam shaft 13 and another end anchored to one end of a spring 74 such that the link shutter 72'" can be reeled up. Another end of the spring 74 is anchored to a frame of the fixing device 20U. Thus, the link shutter 72'" penetrates the inlet duct 70*a* and is supported by the frame of the fixing device 20U through the spring 74. As the cam 12 pivots about the cam shaft 13, the cam 12 causes the link shutter 72'" to selectively open and close the inlet duct 70*a*.

Figure 8:
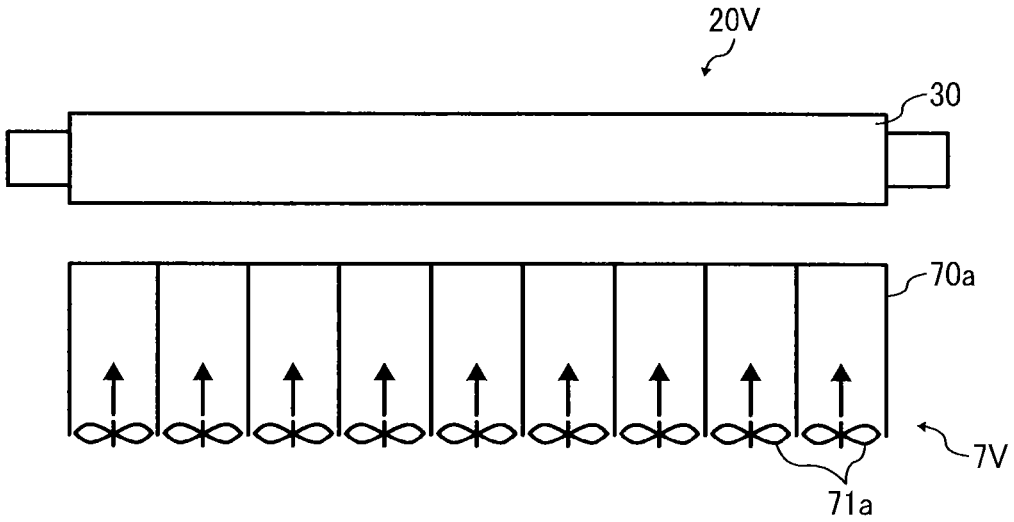
FIG. 8 is a partial side view of a fixing device incorporating a plurality of fans.

With reference to FIG. 8, a description is provided of a configuration of a fixing device 20V incorporating a cooler 7V having the plurality of fans 71*a* selectively actuated to cool the pressing roller 30.

FIG. 8 is a partial side view of the fixing device 20V. As shown in FIG. 8, the fan 71*a* is situated in the air path created in each inlet duct 70*a*. The plurality of fans 71*a* configured to be independently actuated is selectively driven to cool the pressing roller 30 in the variable axial span in the axial direction thereof arbitrarily.

Figure 9:
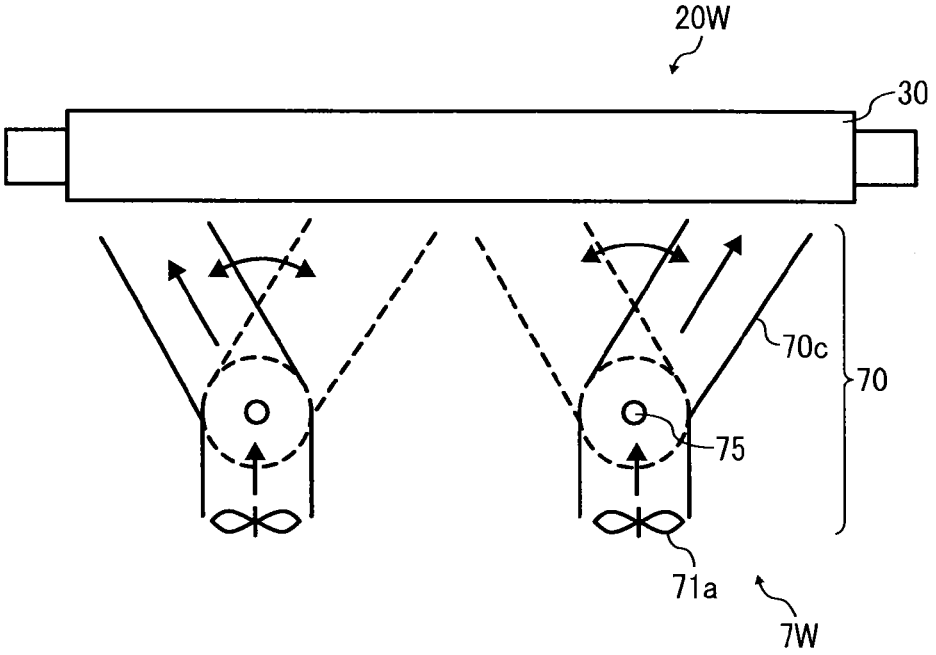
FIG. 9 is a partial side view of a fixing device incorporating a movable inlet duct.

With reference to FIG. 9, a description is provided of a configuration of a fixing device 20W incorporating a cooler 7W having an inlet duct 70 movable in the axial direction of the pressing roller 30.

FIG. 9 is a partial side view of the fixing device 22W. As shown in FIG. 9, the inlet duct 70 includes a pivot portion 70*c* disposed opposite and in proximity to the pressing roller 30. The pivot portion 70*c* is pivotable or swingable about a duct shaft 75. As the pivot portion 70*c* pivots or swings about the duct shaft 75, the inlet duct 70 cools the pressing roller 30 in the arbitrarily variable, axial span in the axial direction thereof with relatively reduced pressure loss. As shown in FIG. 9, the plurality of inlet ducts 70 having the pivot portion 70*c* may be aligned in the axial direction of the pressing roller 30. Alternatively, the inlet duct 70 may be movable in parallel to the axial direction of the pressing roller 30.

According to the exemplary embodiments described above, the fixing devices 20, 20S, 20T, 20U, 20V, and 20W include the fixing belt 22 serving as a fixing rotary body. Alternatively, instead of the fixing belt 22, the fixing devices 20, 20S, 20T, 20U, 20V, and 20W may include a fixing roller, a fixing film, or the like serving as a fixing rotary body separably contacting the pressing roller 30 serving as a pressing rotary body. Further, the fixing belt 22 may be heated by a heater other than the induction heater 24.

According to the exemplary embodiments described above, the fixing devices 20, 20S, 20T, 20U, 20V, and 20W include the pressing roller 30 serving as a pressing rotary body. Alternatively, the fixing devices 20, 20S, 20T, 20U, 20V, and 20W may include a pressing belt or the like serving as a pressing rotary body that separably contacts the fixing rotary body.

According to the exemplary embodiments described above, the recording medium P conveyed over the fixing belt 22 and the pressing roller 30 is centered in the axial direction thereof. Alternatively, the recording medium P may be conveyed over the fixing belt 22 and the pressing roller 30 along one lateral edge in the axial direction thereof. In this case, the link shutters 72', 72", and 72'" and the inlet duct 70 may be disposed opposite one lateral end of the pressing roller 30 in the axial direction thereof.

A description is provided of advantages of the fixing devices 20, 20S, 20T, 20U, 20V, and 20W.

As shown in FIG. 2, the fixing device (e.g., the fixing devices 20, 20S, 20T, 20U, 20V, and 20W) includes a fixing rotary body (e.g., the fixing belt 22) contacting a toner image T on a recording medium P to melt and fix the toner image T on the recording medium P; a pressing rotary body (e.g., the pressing roller 30) to press the recording medium P against the fixing rotary body; and a cooler (e.g., the coolers 7, 7', 7", 7'", 7V, and 7W) to cool the pressing roller 30. The cooler includes a fan (e.g., the fan 71*a*) that moves air to the pressing rotary body and at least one inlet duct (e.g., the inlet ducts 70*a* and 70) interposed between the fan and the pressing rotary body to supply air from the fan to the pressing rotary body. The at least one inlet duct of the cooler selectively cools the pressing rotary body in a variable axial span in the axial direction thereof perpendicular to the recording medium conveyance direction D1.

Accordingly, even if the pressing rotary body having a reduced heat capacity is used to save energy, the cooler suppresses temperature variation of the pressing rotary body in the axial direction thereof. For example, even if the temperature of both lateral ends of the pressing rotary body in the axial direction thereof increases immediately after a plurality of small recording media P is conveyed over the center of the pressing rotary body in the axial direction thereof continuously and therefore does not draw heat from both lateral ends of the pressing rotary body in the axial direction thereof, the cooler cools both lateral ends of the pressing rotary body, achieving even temperature of the pressing rotary body in the axial direction thereof quickly. Indirectly, the cooler prevents uneven temperature of the fixing rotary body. As a result, the cooler prevents formation of a faulty toner image that may arise due to uneven temperature of the pressing rotary body and the fixing rotary body in the axial direction thereof.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:
- a fixing rotary body to directly come into contact with a toner image on a recording medium;
- a pressing rotary body separably pressed against the fixing rotary body to press the recording medium against the fixing rotary body;
- a pressurization assembly contacting the pressing rotary body and movable to press the pressing rotary body against the fixing rotary body and isolate the pressing rotary body from the fixing rotary body; and
- a cooler disposed opposite the pressing rotary body to cool the pressing rotary body, the cooler including:
  - a fan to move air to the pressing rotary body;
  - at least one inlet duct interposed between the fan and the pressing rotary body to supply air from the fan to the pressing rotary body, the at least one inlet duct selectively cooling the pressing rotary body in a variable axial span in an axial direction thereof, and the at least one inlet duct including:
    - a lateral end inlet duct disposed opposite a lateral end of the pressing rotary body in the axial direction thereof, and
    - a center inlet duct disposed opposite a center of the pressing rotary body in the axial direction thereof;
  - a shutter disposed in each of the lateral end inlet duct and the center inlet duct and selectively revolvable to open and close the lateral end inlet duct and the center inlet duct, each shutter being driven to rotate independently;
  - a link shutter connected to the pressurization assembly; and
  - a link shutter shaft about which the link shutter pivots in accordance with movement of the pressurization assembly to open and close the at least one inlet duct.

2. The fixing device according to claim 1, wherein the axial direction of the pressing rotary body is perpendicular to a recording medium conveyance direction.

3. The fixing device according to claim 1, wherein the lateral end inlet duct and the center inlet duct are aligned in the axial direction of the pressing rotary body.

4. The fixing device according to claim 1, wherein the cooler includes a plurality of fans, each of the fans is disposed in one of the lateral end inlet duct and the center inlet duct, and each of the fans is independently actuated.

5. The fixing device according to claim 1, wherein the cooler further includes an outlet duct coupled with the at least one inlet duct to draw air supplied from the at least one inlet duct to the pressing rotary body.

6. The fixing device according to claim 1, further comprising:
- an induction heater disposed opposite at least one of the fixing rotary body and the pressing rotary body; and
- a heat generator made of a magnetic shunt alloy and disposed opposite the induction heater.

7. An image forming apparatus comprising the fixing device according to claim 1.

8. A fixing device comprising:
- a fixing rotary body to come into contact with a toner image on a recording medium;
- a pressing rotary body separably pressed against the fixing rotary body to press the recording medium against the fixing rotary body;
- a pressurization assembly contacting the pressing rotary body and movable to press the pressing rotary body against the fixing rotary body and isolate the pressing rotary body from the fixing rotary body; and
- a cooler disposed opposite the pressing rotary body to cool the pressing rotary body, the cooler including:
  - a fan to move air to the pressing rotary body;
  - at least one inlet duct interposed between the fan and the pressing rotary body to supply air from the fan to the pressing rotary body, the at least one inlet duct selectively cooling the pressing rotary body in a variable axial span in an axial direction thereof, and the at least one inlet duct including:
    - a lateral end inlet duct disposed opposite a lateral end of the pressing rotary body in the axial direction thereof, and
    - a center inlet duct disposed opposite a center of the pressing rotary body in the axial direction thereof;
  - a link shutter connected to the pressurization assembly; and
  - a link shutter shaft about which the link shutter pivots in accordance with movement of the pressurization assembly to open and close the at least one inlet duct.

9. The fixing device according to claim 8, wherein the link shutter is disposed in the lateral end inlet duct.

10. The fixing device according to claim 9, wherein the link shutter is disposed in the center inlet duct.

11. The fixing device according to claim 8, wherein the pressurization assembly includes:

a cam; and a cam shaft about which the cam pivots.

12. The fixing device according to claim 11, wherein the cam shaft extends in parallel to the link shutter shaft.

13. The fixing device according to claim 11, wherein the cam shaft pivotally mounts the link shutter directly.

14. The fixing device according to claim 11, wherein the cam shaft reels up the link shutter.

15. The fixing device according to claim 14, wherein the cooler further includes a spring anchored with one end of the link shutter and another end of the link shutter is anchored to the cam shaft.

16. An image forming apparatus comprising the fixing device according to claim 8.

* * * * *